US005172520A

United States Patent [19]

Hostetler et al.

[11] Patent Number: 5,172,520

[45] Date of Patent: Dec. 22, 1992

[54] WINDOW ASSEMBLY HAVING A HORIZONTALLY SLIDABLE WINDOW UNIT LATCHABLE IN A CLOSED POSITION

[75] Inventors: Paul Hostetler, Sarasota; E. Wayne Burkhart, Venice, both of Fla.

[73] Assignee: Vinyl Tech, Venice, Fla.

[21] Appl. No.: 760,123

[22] Filed: Sep. 16, 1991

[51] Int. Cl.[5] ..... E05D 13/04

[52] U.S. Cl. ..... 49/449; 292/DIG. 46; 292/207

[58] Field of Search ..... 49/449; 52/207; 292/DIG. 46, 207, DIG. 30, DIG. 47

[56] References Cited

U.S. PATENT DOCUMENTS

| | | | |
|---|---|---|---|
| 275,706 | 4/1883 | Rantz et al. . | |
| 385,668 | 7/1888 | Henninger . | |
| 987,285 | 3/1911 | Dare . | |
| 3,093,224 | 6/1963 | Wilson | 49/449 X |
| 3,416,259 | 12/1968 | Kogan | 49/449 X |
| 3,596,954 | 8/1971 | Hull et al. . | |
| 3,600,019 | 8/1971 | Toyota et al. . | |
| 3,785,684 | 1/1974 | Nakanishi | 292/207 X |
| 3,837,191 | 9/1974 | Soiderer . | |
| 3,877,739 | 4/1975 | Cowen . | |
| 3,881,758 | 5/1975 | Gross . | |
| 4,196,602 | 4/1980 | Akselsen | 292/207 X |
| 4,341,043 | 7/1982 | Yamamoto et al. | 49/449 |
| 4,489,965 | 12/1984 | Taylor | 49/449 X |
| 4,674,777 | 6/1987 | Guelck | 292/DIG. 30 X |
| 4,682,455 | 8/1987 | Klompenburg | 52/207 |

*Primary Examiner*—Philip C. Kannan

*Attorney, Agent, or Firm*—Burns, Doane, Swecker & Mathis

[57] ABSTRACT

A window assembly includes a pair of horizontally slidable window units. The window units includes respective inner and outer frame sections which are superimposed when both window units are closed. A latching mechanism is mounted in the inner frame section and includes a rotatable latching arm capable of entering a recess in the outer frame section for latching the window units together in a manner drawing both window units against an intermediate divider wall. When the latching arm is in an unlatching condition, it is capable of being used as a handle to open the associated window units.

16 Claims, 3 Drawing Sheets

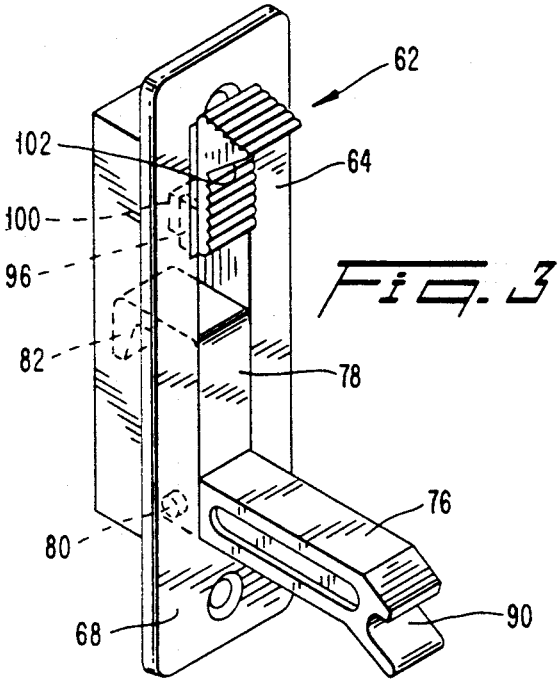
Fig. 3
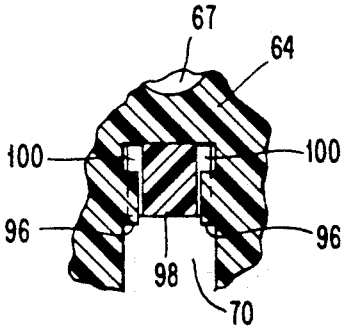
Fig. 6
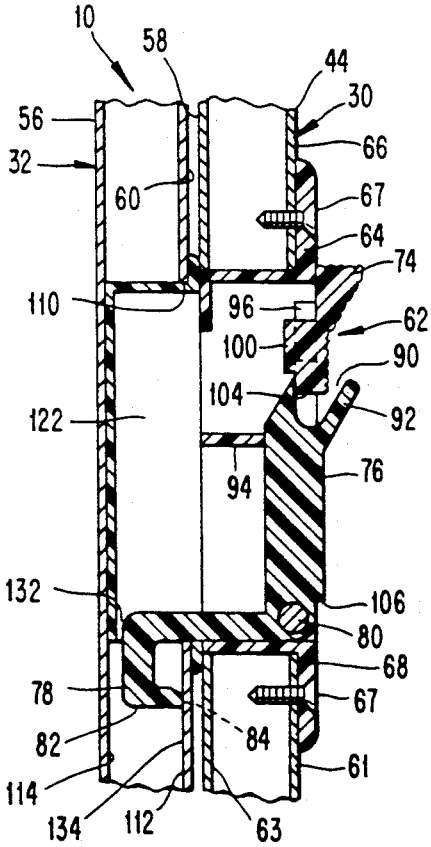
Fig. 4
Fig. 5
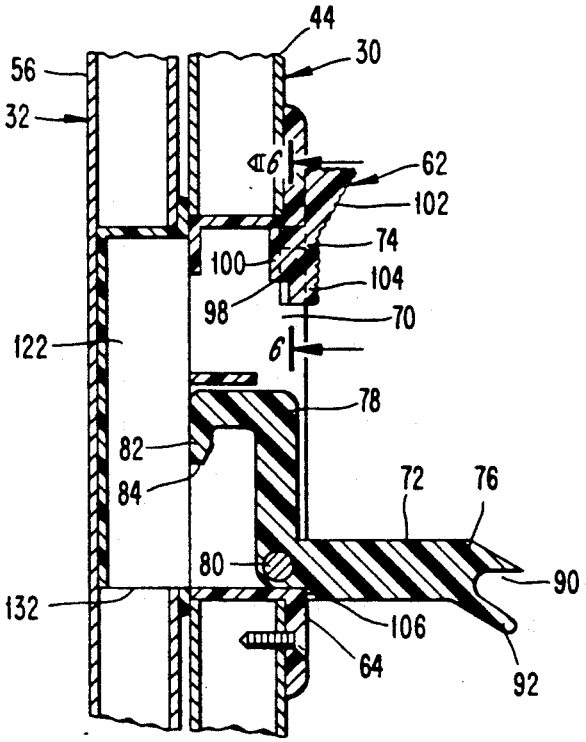

WINDOW ASSEMBLY HAVING A HORIZONTALLY SLIDABLE WINDOW UNIT LATCHABLE IN A CLOSED POSITION

BACKGROUND OF THE INVENTION

The present invention relates to window assemblies and, in particular, to a latching mechanism for horizontally slidable window units.

A latching mechanism for horizontally slidable window units is known, for example, from U.S. Pat. No. 3,600,019. That mechanism comprises a rotary latching arm mounted for rotation on an edge wall of an inside window unit, and a catch mounted on an inwardly facing surface of an outer window unit. In such an arrangement, there may occur a tendency for the user, once having unlatched the window units, to use the latch as a handle to slide the associated window unit open and closed. However, the rotary mounting of the latch is relatively unsupported since it is disposed on an edge wall of the window unit, and may tend to be damaged after the repeated applications of force thereto. Also, the latch/catch hardware is exposed in full view, whereas it may be desirable from an aesthetics standpoint that the hardware be covered as much as possible.

Therefore, it would be desirable to provide a latch for horizontally slidable window units in which the latching hardware is substantially out of view and the latching arm is reinforced to resist being damaged if used as a handle to slide a window unit.

SUMMARY OF THE INVENTION

The present invention relates to a window assembly comprising a frame, and inner and outer window units mounted in the frame. At least the inner window unit is arranged for horizontal sliding movement in the frame between open and closed states. Each window unit includes a secondary frame in which at least one window panel is mounted. Each of the secondary frames includes a vertical frame section arranged such that inner and outer vertical frame sections of the inner and outer window units, respectively, are superimposed when the window units are closed. Each of the inner and outer vertical frame sections includes an inwardly facing surface and an outwardly facing surface. The inner vertical frame section includes a through-hole extending from its inwardly facing surface to its outwardly facing surface. The inwardly facing surface of the outer vertical frame section includes a recess arranged to be in alignment with the through-hole when the inner and outer vertical frame sections are superimposed. A latching mechanism is provided for locking the window units in their closed state. The latching mechanism comprises a latch housing seated in the through-hole, and a latching arm rotatably mounted to the latch housing for movement between latching and unlatching positions. The latching arm includes a handle portion, and a retaining portion arranged to enter the recess in the outer vertical frame section when the latching arm is in its latching position in order to latch the outer and inner window units against sliding movement.

Preferably, the main frame forms inner and outer tracks separated by a divider wall. The inner and outer window units are slidable within the inner and outer tracks, respectively. The latching arm is arranged to draw both of the inner and outer window units against the divider wall when the latching arm is in its latching position.

Preferably, flexible insulative seals are interposed between the divider wall and the secondary frames.

BRIEF DESCRIPTION OF THE DRAWINGS

The objects and advantages of the invention will become apparent from the following detailed description of a preferred embodiment thereof in connection with the accompanying drawings, in which like numerals designate like elements and in which:

FIG. 3 is a perspective view of a latching mechanism according to the present invention, when a latching arm thereof is in an unlatching position;

FIG. 4 a vertical sectional view taken through the latching mechanism when the latching mechanism is mounted in the window assembly, and when the latching arm is in a latching position;

FIG. 5 is a view similar to FIG. 4 when the latching arm has been moved to an unlatching position;

FIG. 6 is a vertical sectional view taken along the line 6—6 in FIG. 5;

DETAILED DESCRIPTION OF A PREFERRED EMBODIMENT OF THE INVENTION

Figure 1:
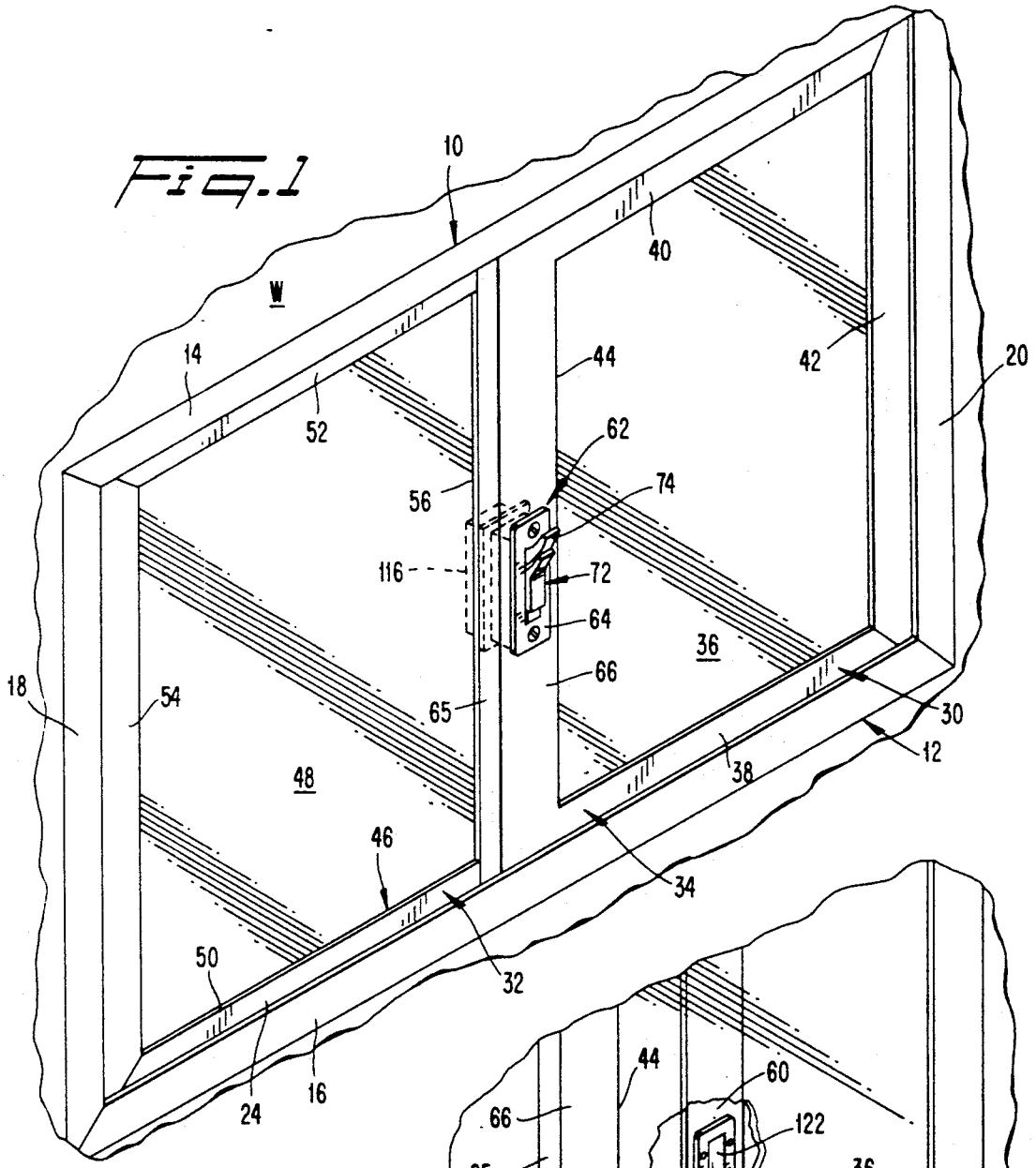
FIG. 1 is a perspective view of a window assembly according to the present invention, when two window units thereof are in a closed state, and a latching mechanism is in a latching position.

In the following description, the terms "inner" and "outer" are defined with respect to the location a window latching mechanism. That is, the latching mechanism is manipulable from an inner side of the window assembly.

A window assembly 10 includes a rectangular main frame 12 mounted in a structural wall W of a building. The frame 12 includes upper and lower horizontal frame parts 14, 16 interconnected by vertical frame parts 18, 20. The lower horizontal frame part 16 includes a track 22 which is divided into inner and outer parallel track sections 24, 26 by a vertical divider wall 28 (see FIG. 2). Likewise, a vertical divider wall (not shown) divides a track (not shown) of the upper frame part 14 into inner and outer track sections.

A pair of inner and outer window units 30, 32 are arranged for sliding movement in the inner and outer track sections 24, 26, respectively. Alternatively, only the inner window unit 30 could be movable; the other unit 32 would be fixed.

The inner window unit 30 includes a rectangular frame 34 in which is mounted at least one window panel or sheet 36 formed of any suitable material, e.g., glass, acrylic, vinyl, etc., is mounted. The frame includes a pair of horizontal frame sections 38, 40 interconnected by a pair of vertical frame sections 42, 44. Likewise, the outer window unit 32 includes a rectangular frame 46 carrying a window sheet 48. That frame includes horizontal frame sections 50, 52 and vertical frame sections 54, 56.

When both window units 30, 32 are in their closed state, a vertical frame section 44 of the inner window unit 30 is superimposed or positioned in front of a vertical frame section 56 of the outer window unit 32, as shown in FIG. 1.

Each of those inner and outer vertical frame sections 44, 56 includes an inwardly facing surface and an outwardly facing surface. The outwardly facing surface 58 (see FIG. 4) of the inner window frame section 44 faces the inwardly facing surface 60 of the outer frame section 56 when the vertical frame sections 44, 56 are superimposed.

The inner window unit 30 carries narrow, flexible sealing strips 61 formed of a suitable thermal insulating material, e.g., felt (see FIG. 2), extending along the horizontal frame sections 38, 40 to face the horizontal frame parts 14, 16 of the main frame 12 in order to create an air seal. Similar sealing strips are disposed on the opposite sides of the frame sections 38, 40 for engaging the divider walls 28. Also, similar sealing strips could be provided on the vertical frame sections 42, 44 for engaging the vertical frame parts 18, 20 as well as vertical divider walls (not shown). The outer window unit 32 can be provided with the same arrangement of sealing strips as the inner window unit 30.

A latching mechanism 62 is provided for latching the window units in their closed state. The latching mechanism 62 comprises a rectangular latching housing 64 seated within a rectangular through-hole disposed in the inner vertical frame section 44. As is evident from FIG. 4, the inner frame section 44 is hollow and formed by inner and outer plates 61, 63, preferably formed of aluminum. Those plates are interconnected by an end plate 65 shown in FIG. 1. The through-hole extends from an inwardly facing surface 66 of the inner plate 61 to the outwardly facing surface 58 of the outer plate 63. The latching housing 64 can be attached to the frame section in any suitable manner, such as by screws 67 passing through holes in a top flange 68 of the latch housing.

The latch housing 64 includes an opening 70 extending therethrough in which are mounted a latching arm 72 and a lock 74. The latching arm 72 includes a handle portion 76 and a retaining portion 78 disposed at right angles to one another. At a corner of the latching arm where the handle and retaining portions intersect, a pair of pins 80 project laterally outwardly and are rotatably mounted within the latch housing 64. Those pins 80 define a horizontal axis of rotation of the latching arm 72, which axis extends parallel to the direction of sliding movement of the window units.

The retaining portion 78 is in the shape of a hook. The hook includes an outer leg 82 having an end surface 84 which faces toward the flange 68 of the latch housing 64 when the latching arm 72 is in a latching position (FIG. 4). In that latching position, the handle portion 76 is oriented vertically within the opening 70.

The handle portion 76 includes an end having therein a recess 90 oriented to face toward the lock 74 when the latching arm 72 is in a latching position (FIG. 4). A portion 92 of the end of the handle portion 76 which borders the recess 90 is inclined inwardly to enable a user's finger to extend into the recess 90 when the latching arm is in a latching position.

Extending horizontally across the opening 70 in the latch housing 64 is a stop bar 94 arranged to be abutted by the handle portion 76 when the latching ar 72 is in the latching position.

The lock 74 is arranged to slide vertically toward and away from the recess 90 when the latching arm 72 is in the latching position. The latch housing 64 includes a pair of tabs 96 projecting into the opening 70 (see FIGS. 3, 4 and 6). The lock 74 includes a tongue 98 which extends through the restricted slot formed between the tabs 96, and a pair of lateral ears 100 which extend outside of and behind the tabs 96 to prevent the lock 74 from falling inwardly out of the opening 70. The ears 100 slide against rear faces of the tabs to produce a friction which yieldably resists vertical sliding movement of the lock 74. An inwardly facing surface 102 of the lock 74 is adapted to be pushed by a user to raise the lock to an unlocking position. The inwardly facing surface can be knurled to facilitate the pushing action.

When the lock has been slid downwardly to its locking position, a bottom flange 104 of the lock extends into the recess 90 of the latching arm 72 to prevent the latter from being swung to its unlatching position.

When the latching arm 72 is in an unlatching position (FIG. 5), the retaining portion 78 is disposed within the recess 70, and the handle portion 76 extends inwardly, i.e., in a direction away from the outer window unit 32. Hence, the handle portion 76 can be used as a handle by the user to slide the inner window unit 30. A lower end of the handle portion 76 includes a notch 106 which, when the latching arm 72 is in an unlatching position, abuts against an inwardly facing surface of the latch housing 68 (see FIG. 5).

Formed in the inwardly facing surface 66 of the frame section 56 of the outer window unit 32 is a rectangular hole 110 (FIG. 4). The frame section 56 is formed of spaced-apart inner and outer aluminum plates 112, 114, and the hole 110 is formed in the inner plate 12. A receiver housing 116 is pres-fit into the hole 110 (see FIG. 7). The receiver housing 116 includes a hollow base portion 118 and a flange 120 extending around an inner edge thereof. The base portion 118 forms a rectangular recess 122. A plurality of projections 124 project laterally outwardly from two long side walls 126 of the base portion 118 near the junction of the base portion and the flange (only one projection being depicted). The projections are integral with the long side walls and include laterally facing surfaces 125 arranged to frictionally contact opposing edges of the plate 112 which border the hole 110. Thus, the receiver housing 116 can be pushed into the hole 110 and frictionally retained therein by such frictional contact. The flange 120 extends laterally past the projections 124 in order to abut the inwardly facing surface 66 of the frame section 56 when the receiver housing 116 has been pushed fully into the hole 110.

The base portion 118 of the receiver housing include a short side wall 130 which interconnects upper ends of the long side walls 126. Lower ends of the long side walls 126 are not interconnected; rather, the base portion 118 forms an opening 132. As a result, when the frame sections 44, 56 are superimposed, and the latching arm 72 is in a latching position (FIG. 4), the leg 82 of the retaining portion 78 is able to contact the outer face 134 of the plate 112. That is, the end face 84 of the leg 82 pushes against that face 134 to pull the outer and inner window units 30, 32 toward one another. Consequently, both window units 30, 32 will be pressed more tightly against the divider wall 28 of the frame 12 to intensify the air seal formed between the window units 30, 32.

In use, a user slides the inner window unit 30 closed, with the handle portion 76 of the latching arm 72 possibly being used as a handle for applying the sliding force. The outer window unit is also closed either by being permanently fixed in a closed position, or by being slid to the closed position. When the inner and outer vertical frame sections 44, 56 are superimposed (FIG. 1), the user swings the handle portion 76 upwardly to its latching position, whereupon the hook-shaped end of the retaining portion 78 of the latching arm enters the recess 122, and the surface 84 of that hook-shaped end bears against the outwardly facing surface 134 of the plate 112 to draw the window units 30, 32 toward one another (see FIG. 4). Consequently, the seal strips between the divider walls 28 and the frames of the window units will be compressed to enhance the air seal. The lock 74 is then slid downwardly to lock the latching arm 72 against rotation (FIG. 4).

Figure 2:
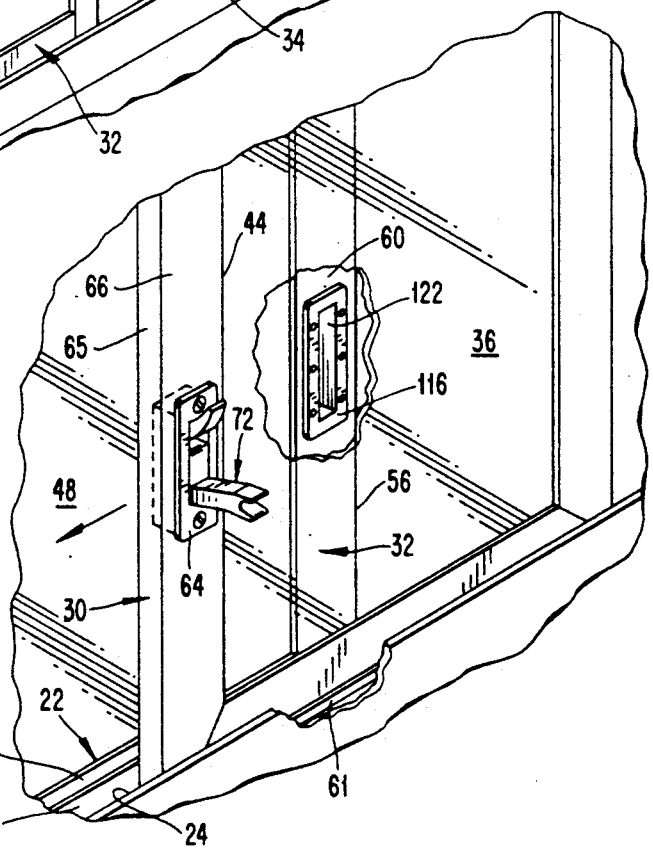
FIG. 2 is a fragmentary view similar to FIG. 1 when the latching mechanism has been unlatched, and one of the window units has been partially opened.

To unlatch the window units, the lock 74 is raised, and the latching arm 72 is swung to its unlatching position, whereupon the retaining portion 78 of the locking arm 72 moves out of the recess 122 (FIG. 5). The handle portion 76 of the locking arm 72 can be gripped by the user and used as a handle for sliding the inner window unit 30 open (FIG. 2).

It will be appreciated that the present invention provides a latching mechanism in which the rotary mount of the latching arm 72 is supported at both axial ends (i.e., both pins 80 are pivotably mounted in a frame) and thus is effectively reinforced against lateral forces applied to the handle portion 78 by the user when sliding the inner window unit open. The entire latching mechanism, including the latching housing, latching arm, lock, and receiver housing can be formed of plastic.

Also, most of the latching hardware especially the latching hook 78 and receiver 116, are hidden from view and thus the latching mechanism does not detract from the overall appearance of the window.

Figure 7:
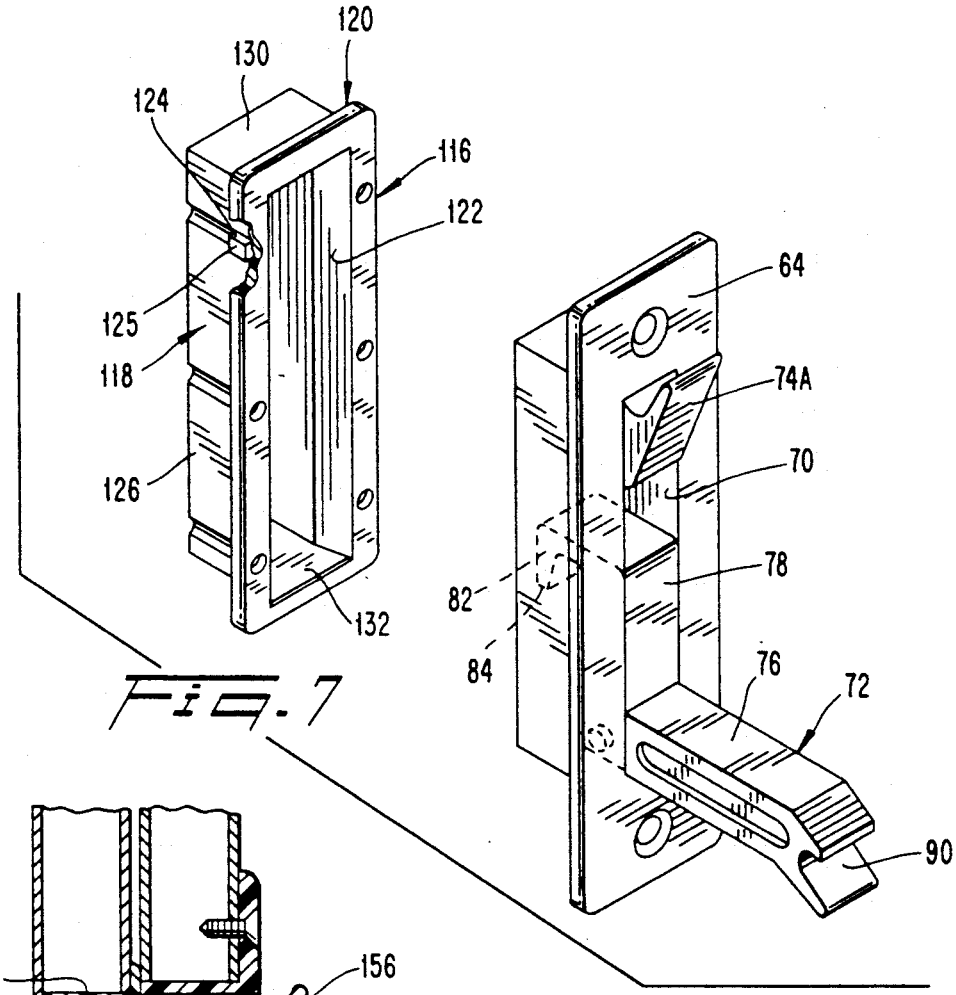
FIG. 7 is an exploded perspective view of a latching mechanism and receiver housing.
Figure 9:
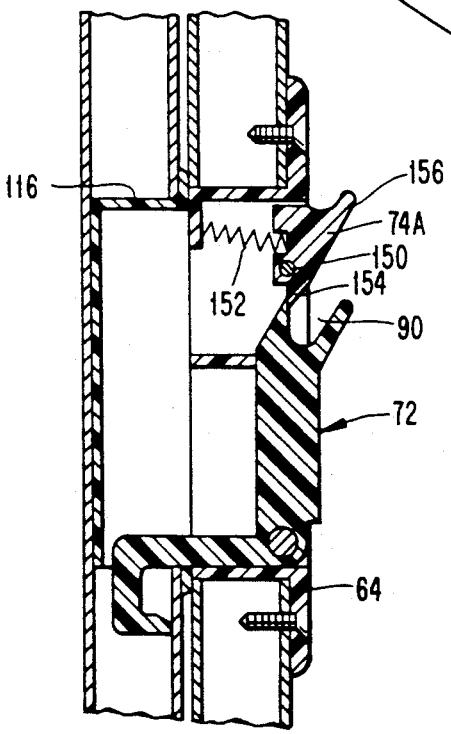
FIG. 9 is a view similar to FIG. 4 of the second embodiment of the invention.
Figure 8:
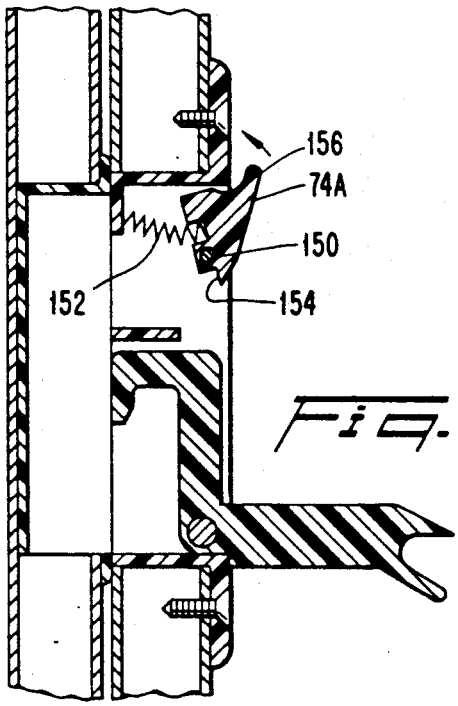
FIG. 8 is a view similar to FIG. 5 of a second embodiment of the, invention.

Instead of being vertically slidable, the lock could be pivotably mounted as depicted in FIGS. 7–9. That is, the lock 74A is pivotably mounted in the latching housing 64 by means of pivot pins 150. A spring 152 biases the lock 74A clockwise to a position in which a lower projection 154 thereof extends downwardly for receipt within the recess 90 of the latching arm 72, as shown in FIG. 9. If a user presses against an upper portion 156 of the lock, the lock can be pivoted counterclockwise to remove the projection 154 from the recess 90, thereby enabling the latching arm 72 to be swung to a non-latching position (FIG. 8).

Although the present invention has bee described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A window assembly comprising:

a main frame;

inner and outer window units mounted in said main frame, at least said inner window unit being arranged for horizontal sliding movement in said frame between open and closed states, each window unit including a secondary frame in which at least one window panel is mounted;

each of said secondary frames including a vertical frame section arranged such that inner and outer vertical frame sections of said inner and outer window units, respectively, are superimposed when said window units are closed, each of said inner each of said inner and outer vertical frame sections including a inwardly facing surface and an outwardly facing surface;

said inner vertical frame section including a through-hole extending from its inwardly facing surface to its outwardly facing surface;

said inwardly surface of said outer vertical frame section including a recess arranged to be in alignment with said through-hole when said inner and outer vertical frame sections are superimposed;

latching means for locking said window units in their closed state, comprising:

a latch housing seated in said through-hole, and a latching arm rotatably mounted to said latch housing for movement between latching and unlatching positions, said latching arm including a handle portion and a retaining portion, said retaining portion arranged to enter said recess in said outer vertical frame section when said latching arm is in its latching position in order to latch said outer and inner window units against relative sliding movement.

2. A window assembly according to claim 1, wherein said main frame forms inner and outer tracks separated by divider wall means, said inner and outer window units being slidable within said inner and outer tracks, respectively, said latching arm arranged to draw both of said inner and outer window units against said divider wall means when said latching arm is in its latching position.

3. A window assembly according to claim 2 including flexible sealing means interposed between said divider wall means and said secondary frames.

4. A window assembly according to claim 1, wherein said latching arm is rotatably mounted to said latch housing for rotation about a horizonal axis extending parallel to a direction of sliding of said window units

5. A window assembly unit according to claim 4, wherein said handle portion is arranged to extend vertically within said through-hole when said latching arm is in its latching position, and to project from said through-hole when said latching arm is in its unlatching position.

6. A window assembly unit according to claim 1, wherein said outer vertical frame section includes an inner plate in which said recess is formed, said inner plate having an outwardly facing surface, said retaining portion of said latching arm being hook-shaped, an end of said hook-shaped retaining portion arranged to face inwardly and bear against said outwardly facing surface of said plate when said latching arm is in its latching position.

7. A window assembly unit according to claim 1, wherein said latching means includes a lock movably mounted to said latch housing for movement between an arm-retaining position for locking said latching arm in its latching position, and an arm-releasing position for releasing said latching arm for movement to its unlatching position.

8. A window assembly unit according to claim 7, wherein said lock is mounted for sliding movement in said latch housing.

9. A window assembly unit according to claim 8, wherein said latch housing, said latching arm, and said lock are formed of plastic.

10. A window assembly unit according to claim 9 including a receiver housing mounted in said recess, said receiver housing formed of plastic and including a pair of walls insertable into said recess, and a flange for engaging said inwardly facing surface of said outer vertical frame section, each of said walls including outward projections disposed immediately outwardly of said flange and arranged to frictionally contact edge surfaces of said recess.

11. A window assembly unit according to claim 1 including a receiver housing mounted in said recess, said receiver housing formed of plastic and including a pair of walls insertable into said recess and a flange for engaging said inwardly facing surface of said outer vertical frame section, each of said walls including outward projections disposed immediately outwardly of said flange and arranged to contact edge surfaces of said recess.

12. A window assembly comprising;

a rectangular main frame, said main frame forming inner and outer horizontal tracks separated by vertical divider wall means;

inner and outer window units arranged for horizontal sliding movement in said inner and outer tracks, respectively, between open and closed states, each window unit including a rectangular secondary frame in which at least one window panel is mounted, each of said secondary frames including a vertical frame section arranged such that inner and outer vertical frame sections of said inner and outer window units, respectively, are superimposed when said inner and outer window units are in said closed state, each of said inner and outer vertical frame sections including an inwardly facing surface and an outwardly facing surface, said inner vertical frame section including a through-hole extending from its inwardly facing surface to its outwardly facing surface; said inwardly facing surface of said outer vertical frame section including a recess arranged to be aligned with said through-hole when said inner and outer vertical frame sections are superimposed;

flexible sealing means interposed between said divider walls and said secondary frames for creating a seal between said window units; and latching means for latching said window units in their closed state, comprising:

a latch housing seated in said through-hole, a latching arm rotatably mounted to said latch housing for rotation between latching and unlatching positions about a horizontal axis extending parallel to a direction of sliding of said window units, said latching arm including a handle portion arranged to extend vertically within said through-hole when said latching arm is in its latching position, and to project out of said through-hole when said latching arm is in its unlatching position, said latching arm including a hook arranged to enter said recess in said outer vertical frame section when said latching arm is in its latching position to latch said outer and inner window units against relative sliding movement and to draw said outer and inner window units against said divider wall means, and a lock movably mounted to said latch housing for movement between an arm-retaining position for locking said latching arm in said latching position, and an arm-releasing position for releasing said latching arm for movement to said unlatching position

13. A window assembly according to claim 12, wherein said outer vertical frame section includes a plate having an outwardly facing surface disposed within said recess, an outer end of said hook arranged to face forwardly and bear against said outwardly facing surface of said plate when said latching arm is in its latching position.

14. A horizontal sliding window unit according to claim 13, wherein said lock is mounted for sliding movement in said latch housing.

15. A horizontal sliding window unit according to claim 13, wherein said latch housing, said latching arm, and said lock are formed of plastic.

16. A horizontal sliding window unit according to claim 15 including a receiver housing mounted in said recess, said receiver housing formed of plastic and including a pair of walls insertable into said recess and a flange for engaging said inwardly facing surface of said outer vertical frame section, each of said walls including outward projections disposed immediately outwardly of said flange and arranged to frictionally contact edge surfaces of said recess.

* * * * *